US007971726B2

(12) United States Patent
Lewis

(10) Patent No.: US 7,971,726 B2
(45) Date of Patent: Jul. 5, 2011

(54) SCREENING APPARATUS

(76) Inventor: Todd Lewis, Cohocton, NY (US)

( * ) Notice: Subject to any disclaimer, the term of this patent is extended or adjusted under 35 U.S.C. 154(b) by 380 days.

(21) Appl. No.: 12/177,279

(22) Filed: Jul. 22, 2008

(65) Prior Publication Data

US 2010/0018908 A1 Jan. 28, 2010

(51) Int. Cl.
*B07B 1/06* (2006.01)

(52) U.S. Cl. ..... 209/282; 209/241; 209/405; 209/421

(58) Field of Classification Search ..... 209/247, 209/405, 420, 421, 912, 274–283
See application file for complete search history.

(56) References Cited

U.S. PATENT DOCUMENTS

| | | | | |
|---|---|---|---|---|
| 3,439,806 | A * | 4/1969 | Kass et al. | 209/260 |
| 4,105,544 | A * | 8/1978 | Stevick | 209/317 |
| 4,363,725 | A * | 12/1982 | Morita et al. | 209/257 |
| 4,591,432 | A * | 5/1986 | Hartl | 209/247 |
| 4,912,862 | A | 4/1990 | Bishop et al. | |
| 4,948,299 | A | 8/1990 | Cronk, Jr. et al. | |
| 5,183,160 | A * | 2/1993 | McClain | 209/234 |
| 5,259,699 | A | 11/1993 | Klamar | |
| 5,261,171 | A * | 11/1993 | Bishop | 37/142.5 |
| 5,363,574 | A | 11/1994 | Osadchuk | |
| 5,430,962 | A | 7/1995 | Osadchuk | |
| 5,479,726 | A | 1/1996 | Bishop | |
| 5,540,003 | A | 7/1996 | Osadchuk | |
| 5,694,709 | A * | 12/1997 | Cronk et al. | 37/142.5 |
| 5,938,373 | A | 8/1999 | Scudder | |
| 6,158,925 | A | 12/2000 | Schleining et al. | |
| 6,186,338 | B1 * | 2/2001 | Douglas | 209/421 |
| RE38,765 | E | 8/2005 | Currey | |
| 7,186,059 | B2 | 3/2007 | Barnes | |
| 7,310,896 | B2 | 12/2007 | Lopata | |

* cited by examiner

*Primary Examiner* — Joseph C Rodriguez
*Assistant Examiner* — Kalyanavenkateshware Kumar
(74) *Attorney, Agent, or Firm* — Brian B. Shaw, Esq.; Stephen B. Salai, Esq.; Harter Secrest & Emery LLP

(57) ABSTRACT

A screening apparatus for processing excavated material from a ditch into fines and roughs is disclosed. The screening apparatus includes an inclined lift conveyor for moving the excavated material upward and depositing the excavated material onto a convex vibrating screen surface. A transfer conveyor having an arcuate belt path as disposed below the separator for introducing the fines to the excavation. The separator includes a reversible motor for providing a first vibration and a second vibration to the separator.

16 Claims, 14 Drawing Sheets

SCREENING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to a screening apparatus, more particularly, to a screening apparatus removably connected to a prime mover for elevating excavated material and separating the elevated material into fines, or padding, for reintroduction into the excavation and roughs for subsequent introduction into the excavation.

2. Description of Related Art

Underground pipelines are generally installed by placing the pipelines in a prepared trench and then filling the trench to cover the pipeline and restore the surface of the ground to the desired condition. While pipelines are often coated for corrosion control, the pipelines are subject to damage by rocks or other hard, sharp objects typically found within excavated material. The pipelines can also be damaged during installation or during subsequent use of the pipelines. During installation, unintended impact with sufficiently large rocks can damage the pipeline. Even after a successful installation, the pipelines typically exhibit some motion with respect to the surrounding soil, such as by thermal expansion or contraction. Thus, the pipelines must be protected from direct contact with rocks and/or other sharp objects that could damage the pipeline after installation.

Buried cables, including power, electrical or fiber optic cables or lines are also susceptible to damage if not properly padded by fine or soft material. Typically, a layer of sand or soil that is free of large rocks is deposited into the trench immediately adjacent to a pipeline or cable to provide uniform support and to protect the pipeline or cable from damage caused by rocks and/or other objects.

While padding, such as sand or rock-free soil, can be brought in from a location remote from the trench, such acquisition and transport of padding is expensive. For burying lines in remote locations, the transport of the padding can represent a substantial cost and delay to the project.

Therefore, padding machines have been developed, wherein the padding machines move along a pile of excavated material and continuously collects the excavated material, separates the fines suitable for padding, and convey the padding into the excavation to pad the pipeline or cable. Prior padding machines offer an improvement over the hauling of sand from a remote location.

However, as buried lines are becoming necessary in more remote locations, such as windmill and solar collector locations, more varied soil conditions are encountered. As the location of the buried lines is often independent of the type of underlying soil, the excavated soil can have a variety of conditions which can lead to difficulty in loading the padding machine as well as processing by the padding machine.

Therefore, the need exists for an improved screening apparatus that can provide enhanced material handling capability as well as efficient separation of the fines and reintroduction of the fines into the trench while leaving the remaining roughs for subsequent introduction into the excavation.

BRIEF SUMMARY OF THE INVENTION

The present disclosure sets forth a screening apparatus for releasably engaging a prime mover for movement along one side of an excavation, picking up excavated material from the one side of the excavation and processing the excavated material into padding material for placement into the excavation. The screening apparatus includes a main frame, a lift conveyor connected to the main frame and including an endless lift belt for rotation about a lower roller and a spaced upper roller, the lift belt being substantially impervious to the passage of excavated material, the lift conveyor inclined from a lower intake end to an upper discharge end; a separator sub-frame pivotally connected to the main frame for adjusting an angle of inclination of the separator sub-frame; a shaker frame connected to the separator sub-frame by a plurality of elastomeric bearings; a screen retained by the shaker frame in a convex configuration; a vibrator mounted to the shaker frame above the screen; and a transfer conveyor below the screen for receiving fines, passing through the screen, the transfer conveyor defining an arcuate belt path transverse to the lift conveyor.

In one configuration of the screening apparatus, the lift conveyor is connected to the main frame by a lift sub-frame, the lift sub-frame being movable between a first angle of inclination and a second angle of inclination with respect to the main frame.

It is further contemplated that the vibrator is rotatable in a first direction and an opposite second direction, to produce a corresponding first vibratory motion to the screen and different second vibratory motion to the screen.

The screening apparatus can further provide that the transfer conveyor is disposable between an operable position and a folded transport position.

An alternative configuration of the screening apparatus further provides contouring rollers in the lift conveyor, intermediate the upper roller and the lower roller.

BRIEF DESCRIPTION OF THE SEVERAL VIEWS OF THE DRAWING(S)

DETAILED DESCRIPTION OF THE INVENTION

Figure 13:
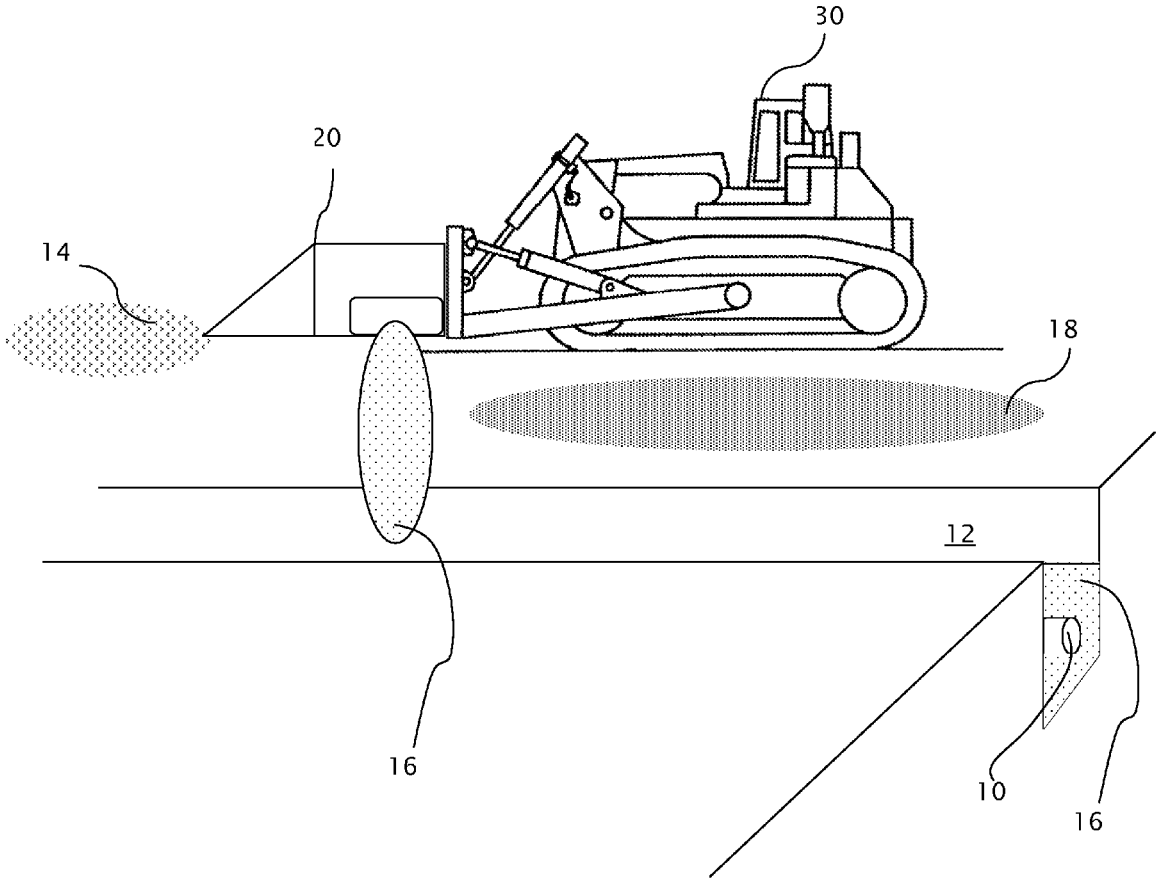
FIG. 13 is a schematic representation of a prime mover locating the screening apparatus relative to an excavation.
Figure 14:
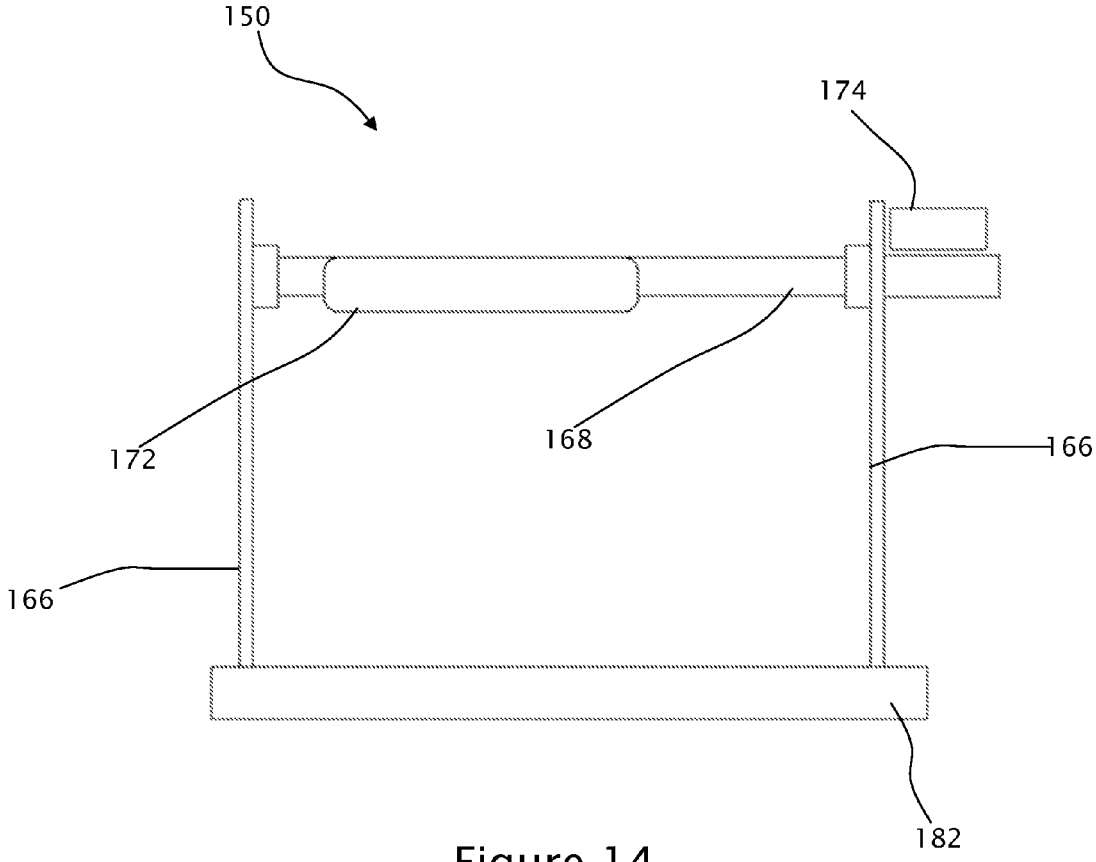
FIG. 14 is a schematic representation of a vibratory for the screening apparatus.

As used herein and seen in FIG. 13, the term "line" or "lines" 10 is used to encompass any type of buried transmission line, including but not limited to pipelines, cables, conduits, wires, such as electrical or optical, and ducts.

The term "excavation" 12 encompasses a hole or trench in the ground resulting from the removal of earth, the removed earth being referred to as "excavated material 14." As stated herein, the terms "fines 16" and "roughs 18" are used to identify the separated excavated material, wherein the fines are first introduced into the excavation as padding.

Figure 1:
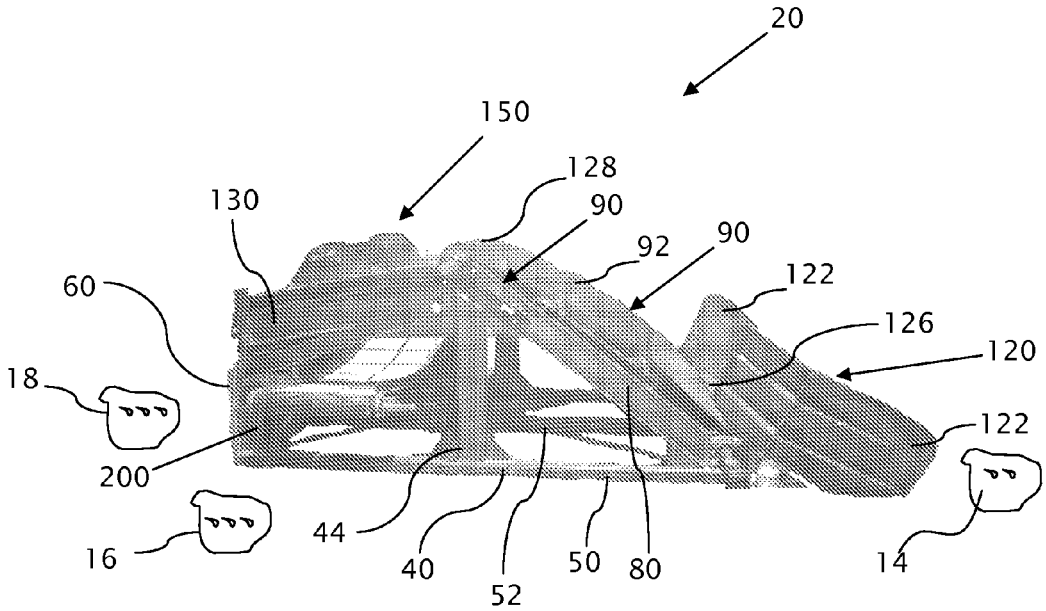
FIG. 1 is a side elevational view of the screening apparatus.
Figure 2:
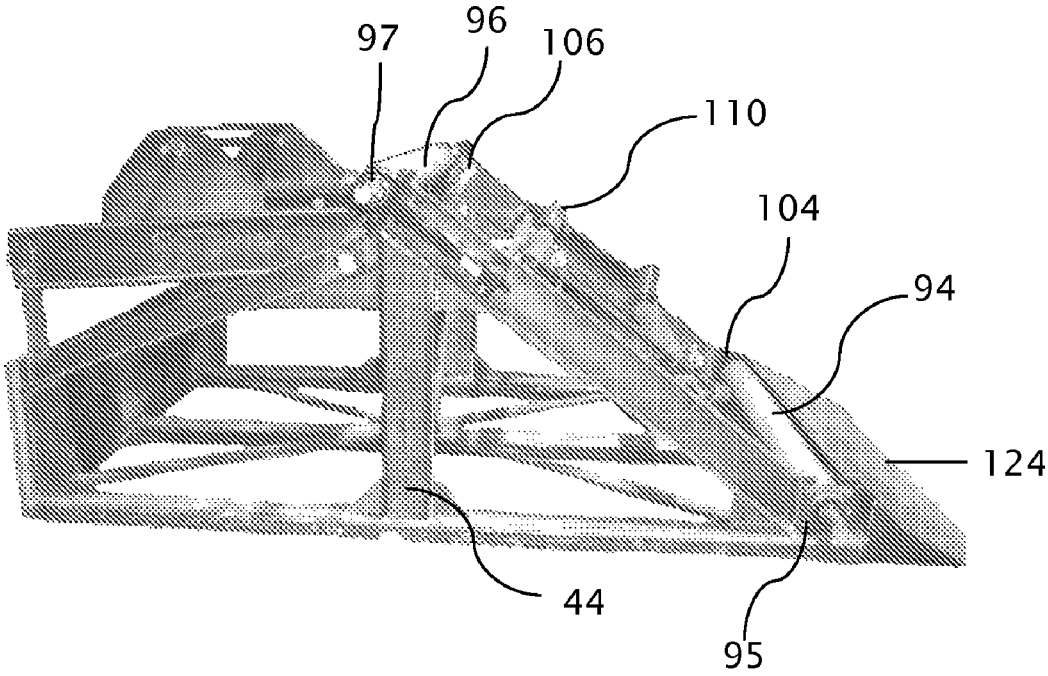
FIG. 2 is a side elevational view of the screening apparatus with the conveyor belt and transfer belt removed.

Referring to FIG. 1, a screening apparatus 20 is provided for separating the excavated material 4 into fines 16 and roughs 18, wherein the fines can be directly deposited into the excavation after separation. The screening apparatus 20 is configured to operably engage a prime mover 30, such as a tractor, dozer or loader. The prime mover 30 provides for the necessary movement of the screening apparatus 20. That is, the prime mover 30 translates the screening apparatus 20 relative to the excavation 12. In one configuration, the prime mover 30 also provides the operative power to the screening apparatus 20.

Generally, the screening apparatus 20 includes a main frame 40; a lift conveyor 90; a separator 150 and a transfer conveyor 200.

The main frame 40 includes a base 50, a face plate 60, a lift sub-frame 80 and a separator sub-frame 130.

The base 50 includes a plurality of rigid beams 52 interconnected to form a self-supporting structure. The face plate 60 is fixedly attached to the base 50 and provides a rigid mount for operably interconnecting the screening apparatus 20 to the prime mover 30.

Figure 6:
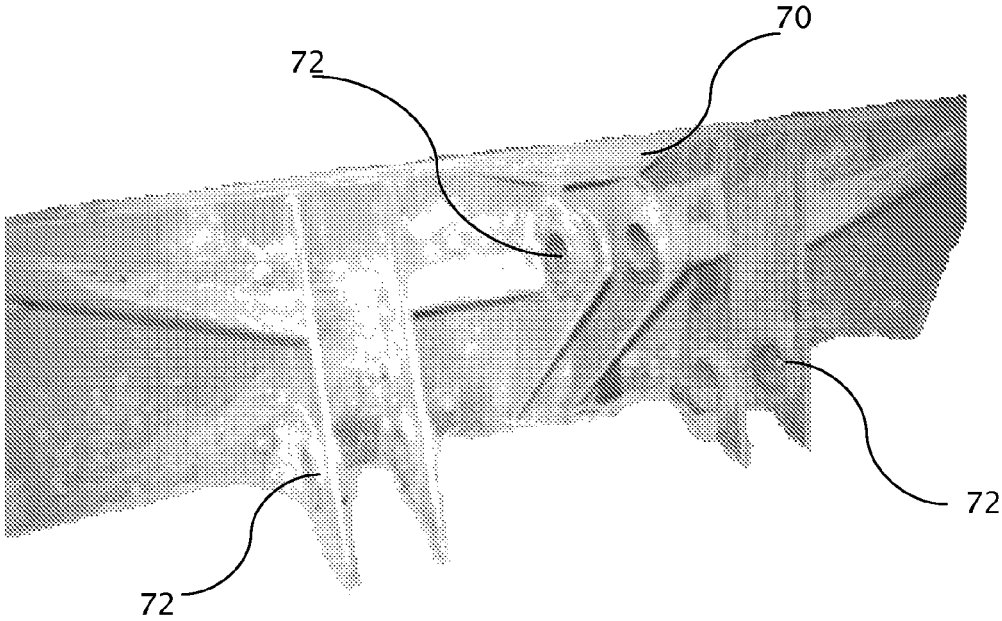
FIG. 6 is a perspective view of an adaptor plate for engaging the screening apparatus.

The face plate 60 is configured for engaging an adapter 70 (shown in FIG. 6), wherein the adapter is selected to operably engage the prime mover 30. The adapter 70 is removably connected to the face plate 30 by any of the varied mechanisms such as bolts, clips, hangers, or clamps. The adapter 70 provides contact or lift points 72 with the prime mover 30 for manipulation of the main frame 40, and hence the screening apparatus 20 relative to the ground, the excavated material 14 and the excavation 12.

In one configuration, the adapter 70 includes three contact points 72 for engaging the prime mover 30. Typically, the contact points 72 provide for pivoting movement of the prime mover 30 relative to the adapter 70.

The lift sub-frame 80 includes a generally rectangular framework of struts 82, including a pair of spaced inclined struts. The inclined struts extend from a lower end 84 to an upper end 86. The upper end 86 can be fixedly attached to the main frame 40, thereby defining a fixed incline angle of the lift sub-frame 80. Alternatively, the lower end 84 is pivotally connected to the main frame 40, thereby allowing the upper end 86 to be disposed at a variety of heights, with respect to the base 50. In such configuration, a center post 44 of the main frame 40 is configured, for engaging and supporting the upper end 86 of the lift sub-frame 80 at the plurality of elevations. Thus, the lift sub-frame 80 can be operably disposed from an inclined angle of approximately 30° to approximately 70°. It is understood the angle of inclination, may be at least partially determined by the composition of the excavated material 14. Movement of the lift sub-frame 80 among the available inclinations can be provided manually or with a motor assist.

The lift conveyor 90 cooperates with the lift sub-frame 80 and includes a conveyor belt 92, a lower roller 94, an upper roller 96 and at least one drive motor 98. The lower roller 94 is rotably connected to the lift sub-frame 80 by journals 95 at the lower end 84 of the lift sub-frame. The upper roller 96 is rotatably connected by journals 97 to the upper end 86 of the lift sub-frame 80. In one construction, at least one of the upper roller 96 and the lower roller 94 is translatable relative to the lift sub-frame 80, such that the spacing between the upper roller and the lower roller can be adjusted to provide a corresponding tensioning of the conveyor belt 92. The tensioning translation can be accomplished by any of a variety of mechanisms known in the art, such as locating the journals 95,97 on slides driven by threaded rods, and selectively rotating the rods to translate the journals, and hence the associated roller.

At least one of the upper roller 96 and the lower roller 94 is driven, such as by an electric motor or a hydraulic motor. In one construction, a lower drive motor 104 is connected to the lower roller 94 and an upper drive motor 106 is connected to the upper roller 96 for selectively rotating the respective rollers. Hydraulic motors have been found satisfactory for the lower drive motor 104 and the upper drive motor 106.

Figure 3:
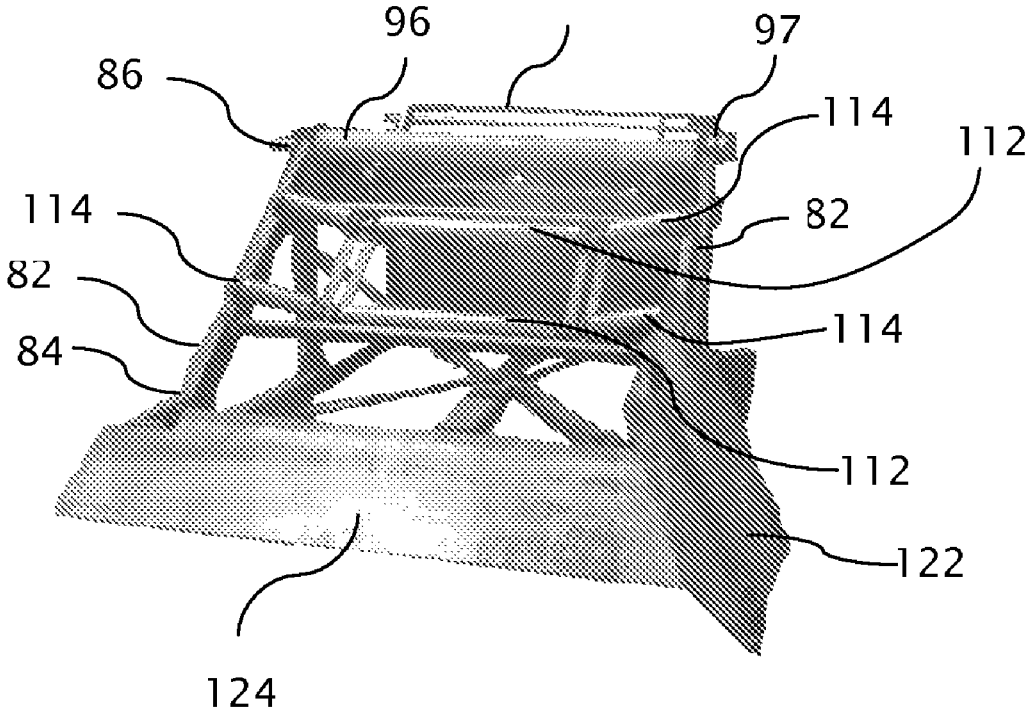
FIG. 3 is a front elevational view of the screening apparatus of FIG. 2, where a portion of the shovel has been included.
Figure 4:
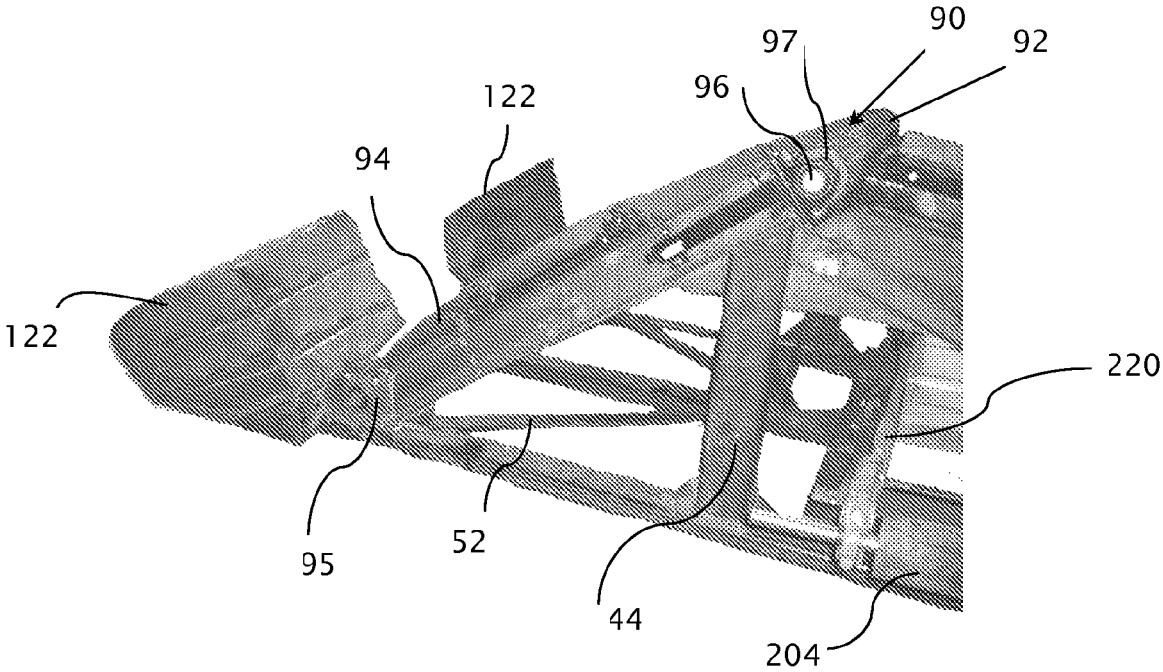
FIG. 4 is a perspective view of the intake end of the screening apparatus.
Figure 5:
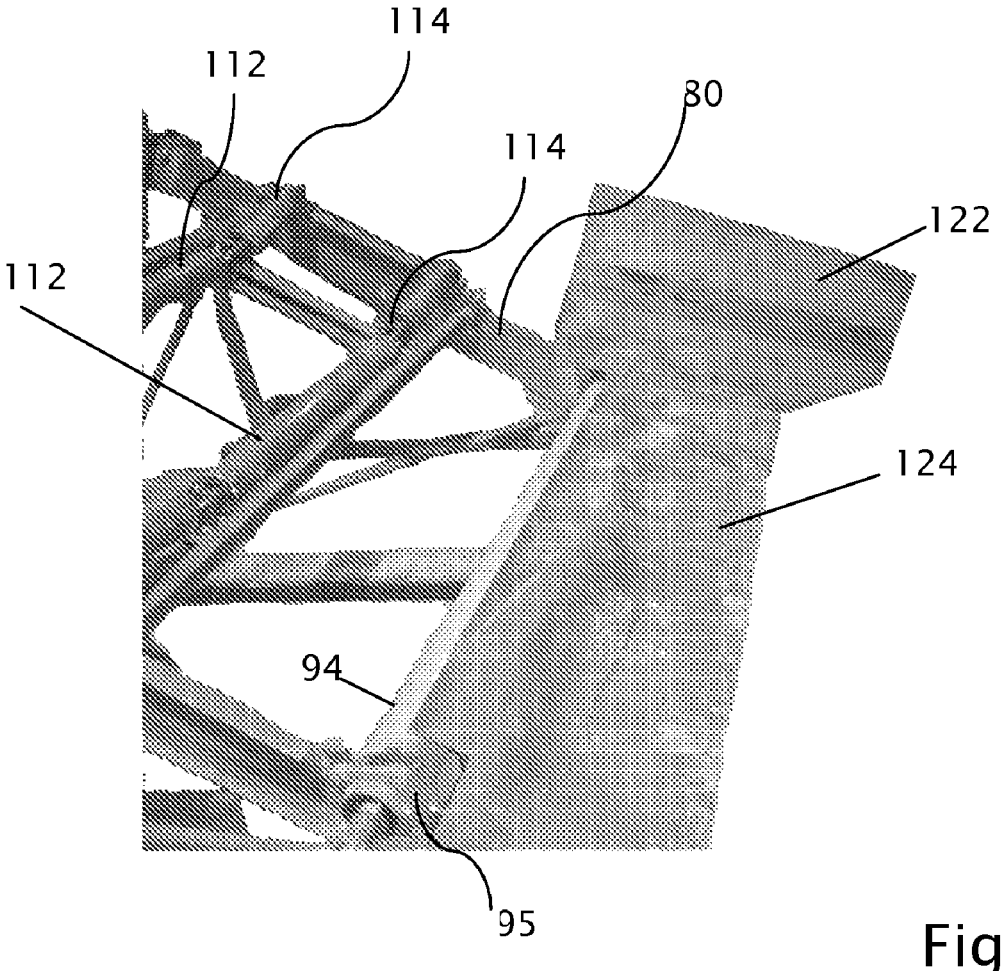
FIG. 5 is a perspective view of a shovel for the screening apparatus.

The lift conveyor 90 can further include a set of contouring rollers 110 intermediate the lower roller 94 and the upper roller 96. As seen in FIG. 3, the contouring rollers 110 incline the edges of the conveyor belt 92 forming a generally trough-shaped cross-section of the conveyor belt.

As seen in FIG. 3, the contouring rollers 100 include a middle roller 112 generally co-planar with the lower roller 94 and the upper roller 96, and an edge roller 114 at each end of the middle roller, wherein each edge roller is inclined relative to the longitudinal axis of the middle roller. The edge rollers 114 are typically inclined toward the center of the conveyor belt 92 between approximately 5° and 60° with a preferable angle of approximately 30°. At least one set of contouring rollers 110 has been found beneficial and a pair of spaced contour rollers has been found satisfactory as shown in FIG. 3.

Typically, the contouring rollers 110 are idler rollers and thus not subject to motive force. However, it is understood the contouring rollers can be driven, and thus operably connected to an associated drive motor, as is well known in the art.

The conveyor belt 92 can be any of a variety of substantially impervious configurations such as screens, or woven or non-woven material, which substantially preclude passage of excavated material through the belt. The conveyor belt 92 forms a continuous or endless belt about the lower roller 94, the upper roller 96 and any intermediate contouring rollers 110. Optionally, the conveyor belt 92 can include transverse paddles 93 for retaining excavated material 14 relative to the conveyor belt along the incline. The lift conveyor 90 thus transfers excavated material from a lower intake end 126 to pass the lifted excavated material from a higher discharge end 128.

The lift conveyor 90 also includes a nose or shovel 120 for introducing excavated material 14 onto the conveyor belt 92. The shovel 120 includes opposing lateral guide plates 122 and a transverse blade 124 extending between the guide plates. The shovel 120 is configured such that excavated material 14 passing from the shovel drops onto the conveyor belt 92. The shovel 120 can be constructed to provide a fixed attack angle, or can be adjustable to provide a variety of attack angles with respect to the excavated material 14. That is, the shovel 120 can be fixed to the main frame 40, such as by bolting, rivets or welding. However, it is understood the shovel 120 can be pivotally mounted to the main frame 40, thereby providing a variable attack angle.

The separator sub-frame 130 includes a generally rectangular framework of struts 132, wherein one side of the separator sub-frame is pivotally mounted to the main frame 40 about a pivot axis 133 that is below the upper end 86 of the lift sub-frame 80 and hence the discharge end 128 of the lift conveyor 90. That is, the separator sub-frame 130 can include a portion below the upper roller 96 and hence below the discharge of the lift conveyor 90. An opposing end of the separator sub-frame 130 is selectively engageable with the main frame 40 to orient the separator sub-frame at an inclined relation relative to the main frame. Thus, the separator sub-frame 130 can be operably disposed from an orientation generally parallel to the base 50, to an inclined orientation of approximately 60°. Movement of the separator sub-frame 130 among the available inclinations can be provided manually or with a motor assist. As the lift sub-frame 130 is inclined, the lift sub-frame defines an upper end 134 and a lower end 136.

The separator 150 cooperates with the separator sub-frame 130, which is pivotally mounted to the main frame 40. The separator 150 includes a shaker frame 160, a screen or mesh 180 and a vibrator 190.

The shaker frame 160 is mounted to the separator sub-frame 130 by a plurality of rubber grommets or coil springs 162. In one configuration, four grommets 162 are used to interconnect the shaker frame 160 and the separator sub-frame 130. Depending upon the anticipated excavated material 14 to be processed and the desired mesh of the fines, a variety of rubber grommets or coil springs 162 can be used.

The shaker frame 160 includes screen support struts 164 extending within the frame, wherein the struts are sized to operable support the screen 180 within the shaker frame. In one configuration, the screen support struts 164 define a generally convex surface for supporting the screen 180. The convex surface can be arcuate in one dimension, thereby forming a generally inverted channel shape. It is also contemplated the screen support struts 164 can define a convex surface having a generally dome shape that has an arcuate shape along intersecting directions.

A pair of spaced flanges 166 extended upwardly from the shaker frame 160. A vibrator 190 is operably connected to the shaker frame 160. The vibrator 190 includes a shaft 168 is rotatably mounted between the flanges 166 and an eccentric weight 172 disposed about the shaft. A hydraulic motor 174 is connected to the shaft 168 for rotating the eccentric weight 172. In one configuration, the hydraulic motor 174 is reversible. That is, the hydraulic motor causes the shaft 168 to rotate in a first or forward direction or an opposite second or reverse direction. Thus, the vibrator 190 imparts a first vibration when rotating the eccentric weight 172 in the first direction and a second vibration when rotating the eccentric weight in the opposite second direction.

Figure 8:
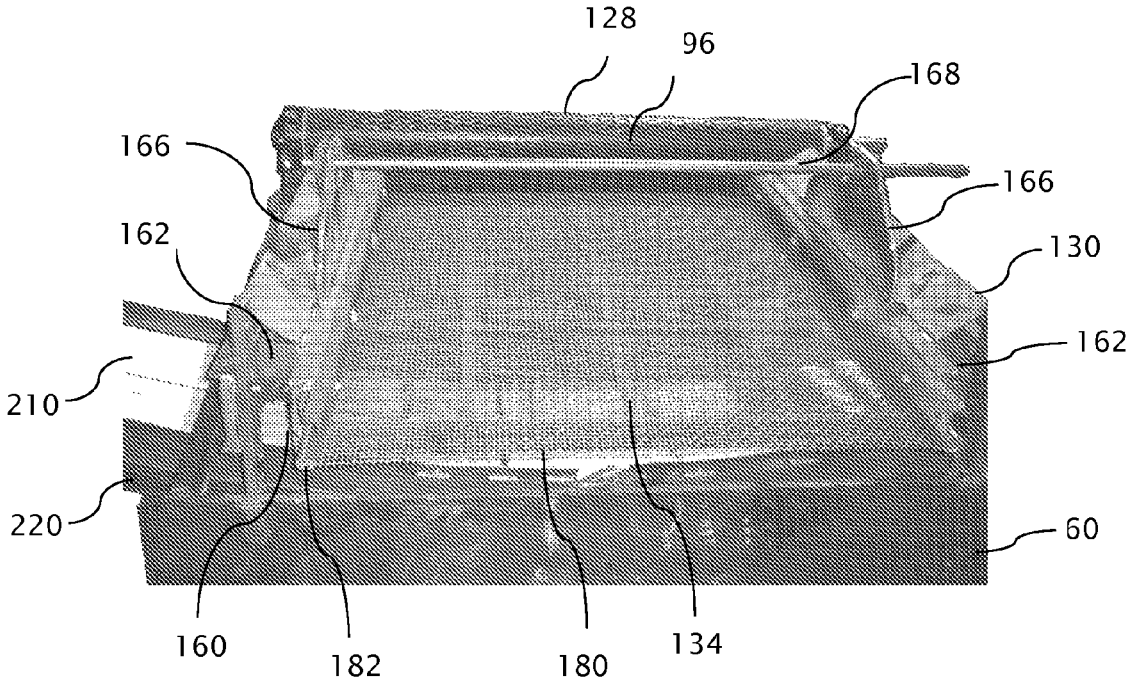
FIG. 8 is an enlarged end view of a portion of the screening apparatus of FIG. 7.
Figure 10:
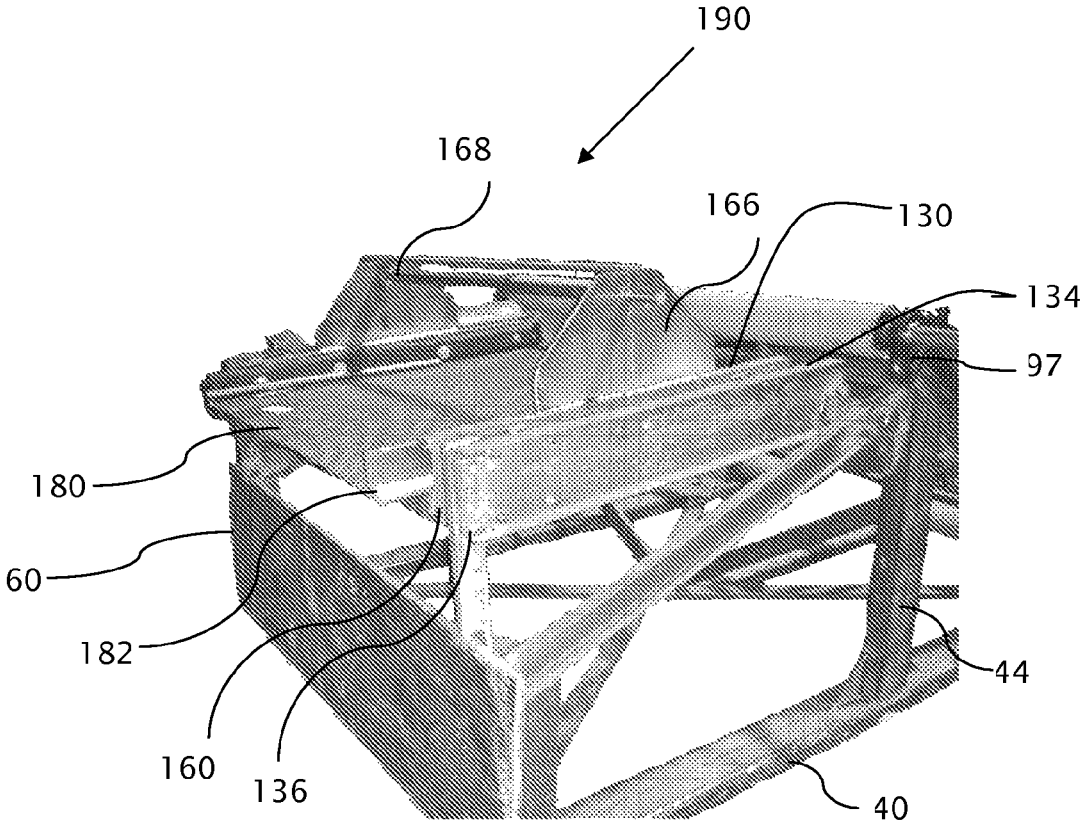
FIG. 10 is a perspective view of the screening apparatus as shown in FIG. 2.
Figure 11:
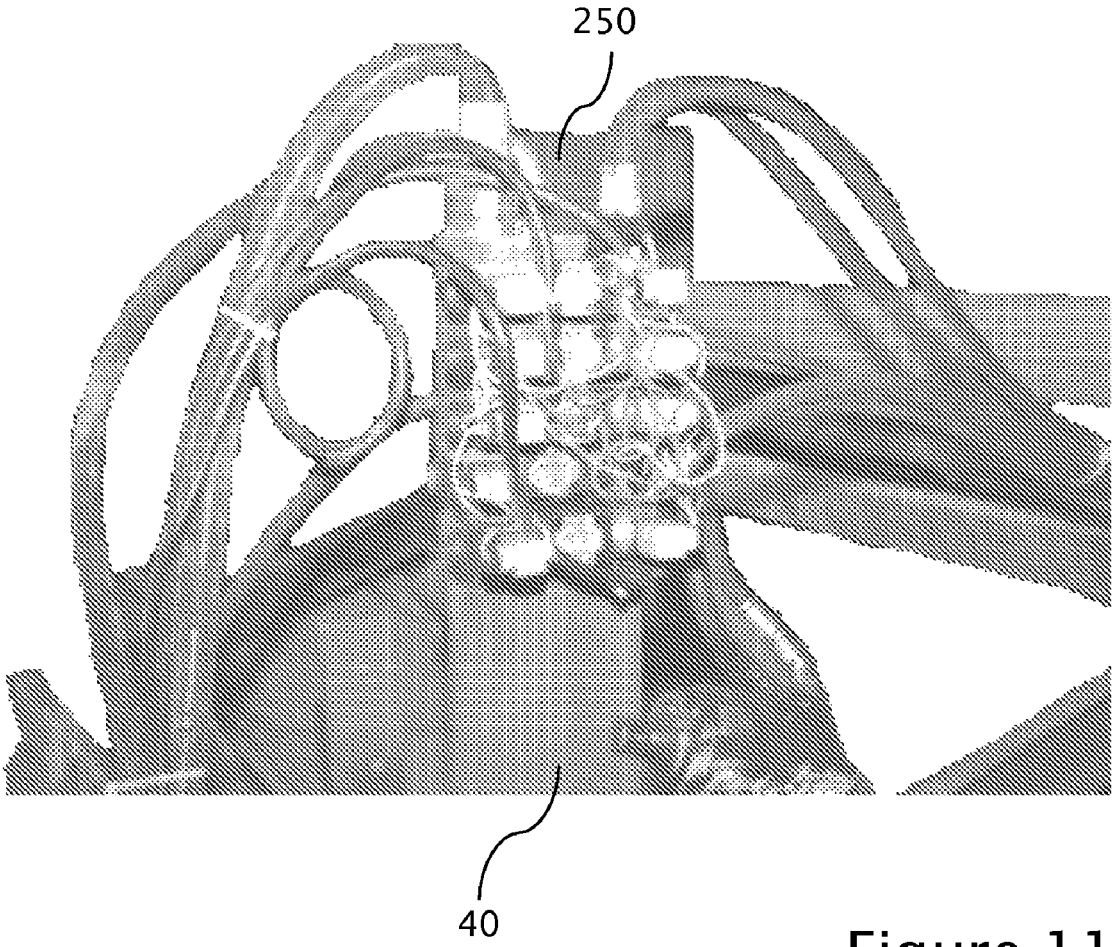
FIG. 11 is an elevational view of a control assembly for the screening apparatus.
Figure 12:
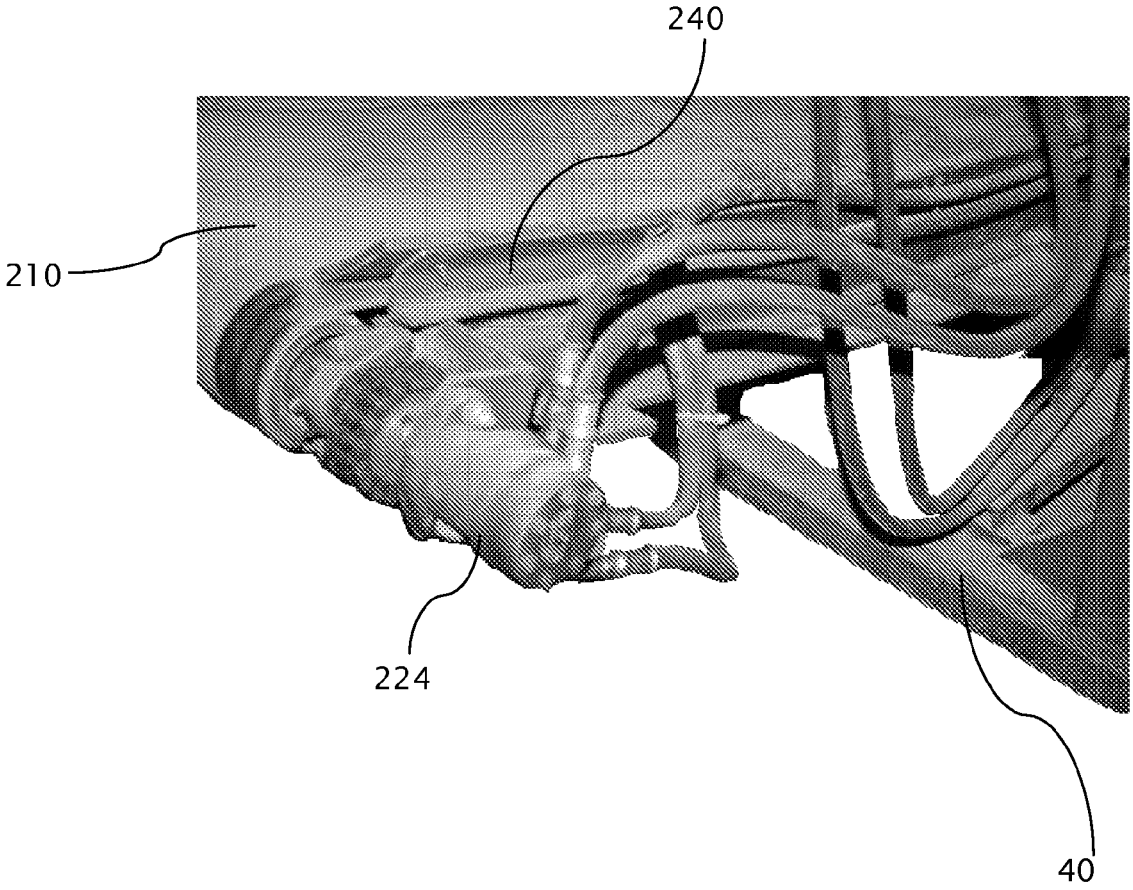
FIG. 12 is a perspective view of an end of the transfer conveyor.

Referring to FIGS. 8 and 10, a screen frame 182 is slidably disposed within the shaker frame 160, wherein the screen frame retains the respective mesh 180 for separating the excavated material 14.

In one configuration, the shaker frame 160 includes a pair of spaced channels 176 for slidably receiving the screen frame 182. The screen frame 182 can be operably connected to the shaker frame 160 by any of a variety of mechanisms including bolt, fasteners, and clamps.

Figure 7:
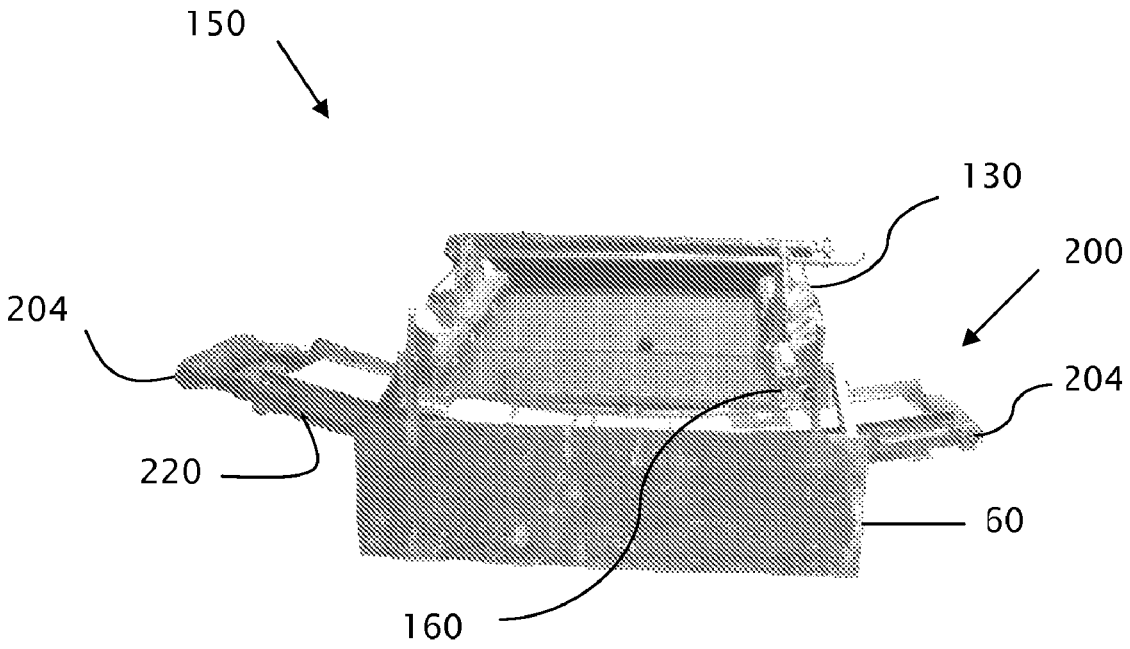
FIG. 7 is a rear end view of the screening apparatus.

As seen in FIGS. 7, 8 and 10, the shaker frame 160 is located below the upper end 86 of the lift conveyor 90, thereby receiving the excavated material 14 passing from the discharge end 128 lift conveyor.

As seen in FIG. 8, the eccentric weight 172 is disposed in the general center of the screen 180. Thus, the vibratory motion imparted to the screen 180 is generally applied from the center of the screen.

Figure 9:
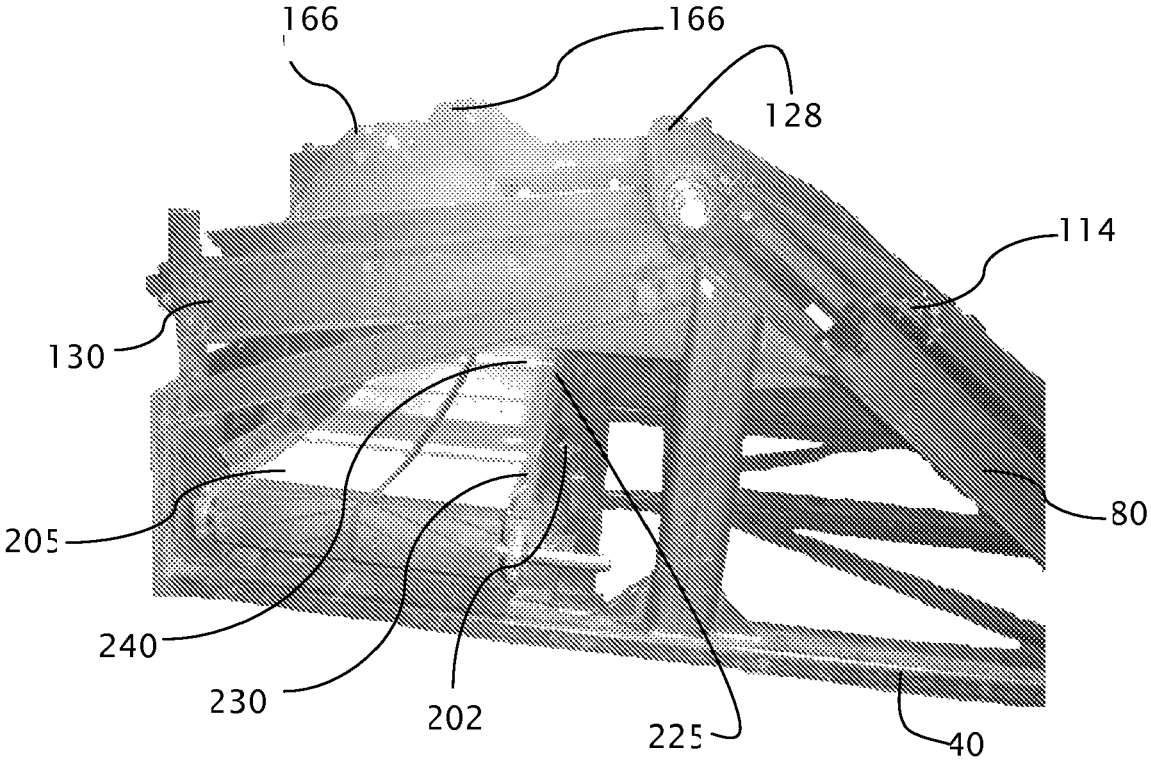
FIG. 9 is a side elevational view of the screening apparatus of FIG. 1.

Referring to FIGS. 7 and 9, the transfer conveyor 200 is disposed below the separator 150. The transfer conveyor 200 includes a plurality of rollers 202 defining a generally arcuate belt path 205, about which is disposed a flexible belt 210.

The transfer conveyor 200 includes a transfer sub-frame 220 to which the plurality of rollers 202 are rotatably mounted to define the substantially arcuate belt path 205. The plurality of rollers 202 includes terminal drive rollers 204, wherein at least one of the drive rollers is movable relative to the transfer sub-frame 220 to provide tensioning of the belt 210.

In one configuration, the entire transfer sub-frame 220 is laterally translatable relative to the main frame 40, thereby accommodating various distances between the screening apparatus 20 and the excavation 12.

In an alternative configuration, the lateral translation of the transfer conveyor 200 can be accomplished by translating the transfer sub-frame 220 along the arcuate path such that the end of the transfer conveyor remote from the main frame 40 raises in elevation as the end of the transfer conveyor moves away from the main frame.

The transfer conveyor 200 further includes a motor 224, such as a hydraulic motor for rotating the transfer conveyor. In one configuration, a hydraulic motor 224 is operably engaged with each of the terminal rollers 204 of the transfer conveyor, wherein the hydraulic motors are reversible, thereby providing for the selective discharge of screened material from either side of the main frame 40.

The transfer sub-frame 220 further includes an intermediate pivot 225 defining a first section 230 and second section 240 of the transfer conveyor 200. In one configuration, at least one of the first section 230 and the second section 240 of the transfer conveyor 200 has a length that is less than the width of the main frame 40 and the remaining of the first section and the second section can be pivoted about the pivot 225, so as to be folded upward and overlay a portion of the main frame, thereby remaining within the width of the main frame.

The pivoted construction of the transfer sub-frame 220 allows for a relatively wide transfer conveyor 200, which can be movable between a transport position for over-the-road hauling and an elongated operable position for providing fines to the excavation 12.

In one configuration, each of the hydraulic motors is operably connected to a control panel 250, wherein the control panel is operably connected to the hydraulic system of the prime mover 30. The control panel 250 provides for the operation and synchronization of each of the hydraulic motors. The control panel includes valving and switching as is known in the hydraulic control art, and provides for reversible operation of the operably connected hydraulic motors.

Typical dimensions of the main frame 40 include an approximately 100" to 180" long base 50, wherein the transfer conveyor 200 has an operable length of between approximately 8' to approximately 15'. A typical width of the main frame 40 is approximately 60" to approximately 96". The lift conveyor 90 has a length of approximately 50" to 100" with a satisfactory length limit of approximately 75", wherein the upper roller 96 is approximately 3' to 5' with a satisfactory height of approximately 4' from the base 50. The screen frame 182 has a length of approximately 55" along the longitudinal dimension of the frame. The transfer conveyor 200 has a width of approximately 24".

In operation, the adaptor 70 is connected to the face plate 60. The prime mover 30 then engages the lift points 72 of the adapter 70 to provide for changing the orientation of the screening apparatus 20. The control panel 250 of the screening apparatus 20 is connected to the hydraulic system of the prime mover 30.

The prime mover 30 then directs the blade 124 of the shovel 120 to capture a cross-section of an elongate row of elevated material 14, typically, such as produced during formation of the excavation 12. The excavated material 14 is guided through the shovel 120 and onto the intake end 126 of the lift conveyor 90 and the moving conveyor belt 92.

As the conveyor belt 92 passes the contouring rollers 110, the excavated material 14 is shifted on the belt and is thus generally distributed within the central 80% of the width of the conveyor belt.

The contoured, excavated material 14 then passes over the upper roller 96 at the upper discharge end 128 and falls onto the screen 180 of the separator 150. The generally convex shape of the screen 180 is aligned with the material falling from the lift discharge end 128 of the conveyor 90. The convex shape of the screen 180 tends to distribute the excavated material 14 across the screen.

The vibrator 190 is operated to impart a vibration to the shaker frame 160 and hence screen 180. For certain conditions of excavated material, it has been found advantageous to operate the vibrator 190 so that the bottom half of the path of the eccentric weight 172 is directed towards the lift conveyor 90. Thus, rotation of the vibrator motor tends to retain the excavated material 14 on the screen 180, thus subjecting the excavated material to increased separation forces on the screen. The increased exposure to separation forces provides enhanced passage of the fines 16 through the screen 180, thereby increasing the amount of available padding.

The roughs 16 do not pass through the screen 180 but are directed by the incline of the separator 150, by virtue of the inclination of the separator sub-frame 130, to fall from the open edge of the screen 180 to the ground.

The fines 14 pass through the screen 180 and onto the transfer conveyor 200. The transfer conveyor 200 is laterally translated and the speed of the transfer conveyor is selected to discharge the fines 14 into the excavation 12, thereby providing the required padding.

The screening apparatus 20 provides a number of advantages. The lift conveyor 90 is open-sided, particularly in the area of the contouring rollers 110. Thus, lateral compaction of the excavated material 14 is reduced. By reducing lateral compaction, continuous processing of excavated material is enhanced. Further, the contouring rollers 110 urge the excavated material 14 to a central distribution, such that upon passing from the discharge end 128 the excavated material impacts the convex shape of the screen 180 and is distributed over the screen. The ability to readily remove the screen 180 allows the operator to quickly provide for different size fines. in addition, by selectively direction of rotation of the eccentric weight, differing types and amount of separation forces can be imparted to the excavated material 14, thereby allowing the processing to be changed in accordance with changing types of excavated material.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

The invention claimed is:

1. A screening apparatus for releasably engaging a prime mover for movement along one side of an excavation, picking up excavated material from the one side of the excavation and processing the excavated material into padding material for placement into the excavation, the screening apparatus comprising:

(a) a main frame having a pivotally mounted separator sub-frame, the separator sub-frame movable between a first angle of inclination and a different second angle of inclination;

(b) a lift conveyor connected to the main frame and including an endless conveyor belt for rotation about a lower roller and a spaced upper roller, the conveyor belt being substantially impervious to the passage of excavated material, the lift conveyor being inclined from a lower intake end to an upper discharge end;

(c) a shaker frame connected to the separator sub-frame and spaced below the discharge end;

(d) a screen fixed to the shaker frame, the screen having a convex configuration and disposed below the discharge end and receiving the excavated material passing from the discharge end;

(e) a vibrator operably coupled to the shaker frame; and (f) a transfer conveyor below the screen for receiving fines, passing through the screen, the transfer conveyor passing about a first end roller and a spaced apart second end roller, wherein a length of a conveyor path intermediate the first end roller and the second end roller is lower than the first end roller and the second end roller thereby defining an arcuate belt path transverse to the lift conveyor.

2. The screening apparatus of claim 1, wherein the lift conveyor is connected to the main frame by a lift sub-frame, the lift sub-frame being movable between a first angle of one connection and a second angle of inclination with respect to the main frame.

3. The screening apparatus of claim 1, wherein the vibrator is rotatable in a first direction and an opposite second direction to impart a corresponding first vibration to the screen and different second rotation to the screen.

4. The screening apparatus of claim 1, wherein the transfer conveyor is moveable between an operable position and a folded transport position.

5. The screening apparatus of claim 1, wherein the vibrator is reversible.

6. The screening apparatus of claim 1, further comprising contouring rollers in the lift conveyor, intermediate the upper roller and the lower roller, the contouring rollers inclining edges of the conveyor belt to form a generally trough shaped cross section of the conveyor belt.

7. The screening apparatus of claim 6, wherein the contouring rollers include a central roller coplanar with the lower roller and the upper roller, and an edge roller at each end of the central roller, each edge roller being inclined relative to a longitudinal axis of the central roller.

8. The screening apparatus of claim 1, wherein the transfer conveyor is moveable transverse to the lift conveyor.

9. A screening apparatus for releasably engaging a prime mover for movement along one side of an excavation, picking up excavated material from the one side of the excavation and processing the excavated material into padding material for placement into the excavation, the screening apparatus comprising:

(a) a main frame having an adjustable separator sub-frame;

(b) a lift conveyor connected to the main frame and including an endless lift belt for rotation about a lower roller and a spaced upper roller, the lift belt being substantially impervious to the passage of excavated material, the lift conveyor inclined from a lower intake end to an upper discharge end;

(c) a shaker frame coupled to the separator sub-frame;

(d) a screen retained by the shaker frame to be disposed below the discharge end to receive the excavated material passing from the lift conveyor and disposed in a convex shape;

(e) a vibrator mounted to the shaker frame above the screen, the vibrator being reversible between a forward rotation and a reverse rotation, the forward rotation imparting a first vibratory motion to the screen and the reverse rotation imparting a second vibratory motion to the screen; and (f) a transfer conveyor below the screen for receiving fines passing through the screen, the transfer conveyor movable in a first transverse direction and an opposite second transverse direction.

10. The screening apparatus of claim 9, wherein the transfer conveyor has an arcuate belt path.

11. The screening apparatus of claim 9, wherein the transfer conveyor is rotatable about an intermediate pivot between a folded transport position and an open operable position.

12. The screening apparatus of claim 9, further comprising contouring rollers in the lift conveyor, the contouring rollers urging the excavated material from the edges of the lift conveyor.

13. A method of screening excavated material into fines and roughs, the method comprising:

(a) elevating excavated material along a lift conveyor having a conveyor belt substantially impervious to the excavated material, the conveyor belt having a path length with a cross section defined by a pair of opposing edges being higher than a central portion of the conveyor belt;

(b) passing the elevated excavated material from an upper end of the lift conveyor onto a screen having a convex surface, the screen fixed relative to a shaker frame;

(c) vibrating the screen with a vibrator mounted above the screen to pass fines through the screen, the vibrator operable in one of a forward direction of rotation and a reverse direction of rotation, the forward direction of rotation imparting a first vibratory motion to the screen and the reverse direction of rotation imparting a different second vibratory motion to the screen; and (d) transferring the fines passing through the screen along an arcuate path on a transfer conveyor to discharge the fines at a position transverse to the lift conveyor.

14. The method of claim 13, further comprising contouring the lift conveyor to urge the excavated material away from the edges of the lift conveyor.

15. The screening apparatus of claim 1, wherein the vibrator is operably coupled to the shaker frame above the screen.

16. The screening apparatus of claim 9, wherein the vibrator is mounted to the shaker frame above the screen.

* * * * *